United States Patent [19]

Doscher

[11] Patent Number: 4,610,304

[45] **Date of Patent: * Sep. 9, 1986**

[54] HEAVY OIL RECOVERY BY HIGH VELOCITY NON-CONDENSIBLE GAS INJECTION

[76] Inventor: Todd M. Doscher, The Doschers Group, 740A E. Main St., Ventura, Calif. 93001

[ * ] Notice: The portion of the term of this patent subsequent to May 14, 2002 has been disclaimed.

[21] Appl. No.: 675,133

[22] Filed: Nov. 27, 1984

Related U.S. Application Data

[63] Continuation-in-part of Ser. No. 452,200, Dec. 22, 1983, Pat. No. 4,516,636.

[51] Int. Cl.[4] ..... E21B 43/24; E21B 43/243

[52] U.S. Cl. ..... 166/261; 166/268; 166/272; 166/273; 166/274

[58] Field of Search ..... 166/261, 268, 270, 272, 166/273, 274, 271

[56] References Cited

U.S. PATENT DOCUMENTS

| | | | |
|---|---|---|---|
| 3,129,757 | 4/1964 | Sharp | 166/261 |
| 3,279,538 | 10/1966 | Doscher | 166/272 X |
| 3,847,219 | 11/1974 | Wang et al. | 166/272 X |
| 3,853,178 | 12/1974 | Shen | 166/272 |
| 4,068,717 | 1/1978 | Needham | 166/272 |
| 4,086,964 | 5/1978 | Dilgren et al. | 166/272 |
| 4,393,937 | 7/1983 | Dilgren et al. | 166/272 |
| 4,516,636 | 5/1985 | Doscher | 166/272 |

*Primary Examiner*—George A. Suchfield
*Attorney, Agent, or Firm*—Jerry Cohen; M. Lawrence Oliverio; William E. Noonan

[57] ABSTRACT

Oil recovery method using injection of non-condensible gas (1) into an oil zone (16) via perforations along the length of an injection well (12) to drive oil through the zone to a production well (14), with the gas injected at a rate no greater than 2,000,000 SCFD per acre and with sufficient velocity to emulsify the oil.

22 Claims, 10 Drawing Figures

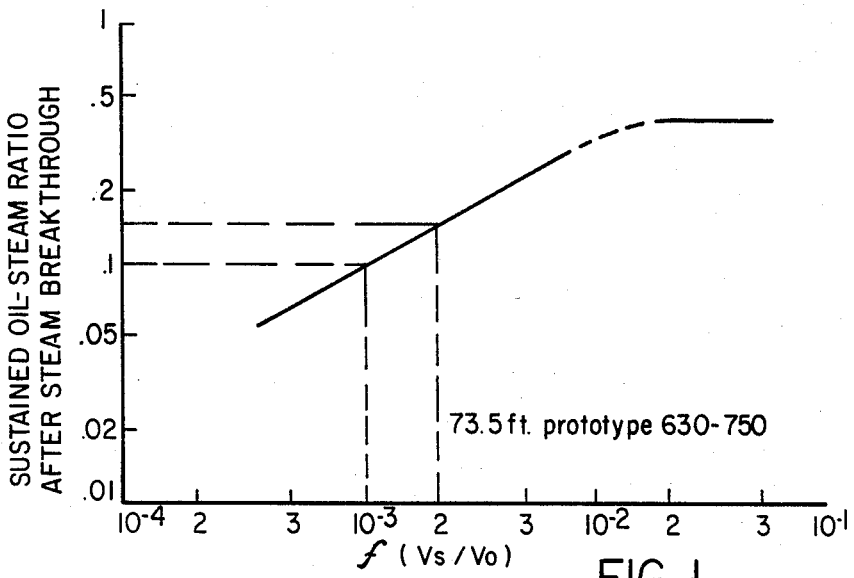
FIG. 1
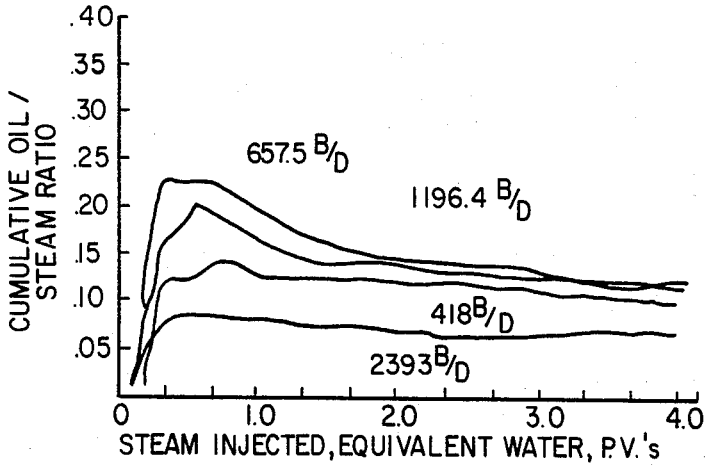
FIG. 2 THE RESULTS OF SCALED PHYSICAL MODEL EXPERIMENTS SHOWING THE OCCURRENCE OF AN OPTIMUM INJECTION RATE (VELOCITY) OF STEAM INJECTION IN MAXIMIZING THE OIL STEAM RATIO.

MODEL EXPERIMENTS DEMONSTRATING THE EFFECT OF THE VELOCITY OF HIGH VELOCITY GAS ON THE DISPLACEMENT AND PRODUCTION OF CRUDE OIL FROM POROUS MEDIA.

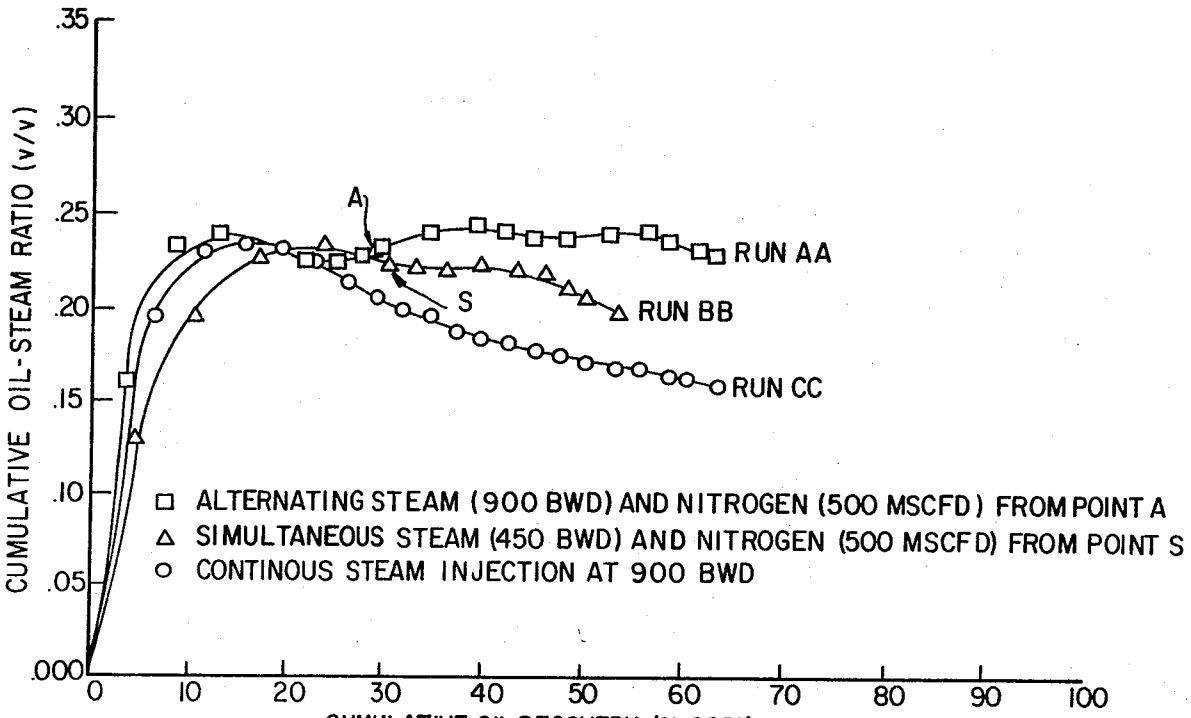
FIG. 5 THE RESULTS OF SCALED PHYSICAL MODEL EXPERIMENTS DEMONSTRATING THE EQUIVALENCE OF HIGH VELOCITY INERT GAS (NITROGEN) TO STEAM IN DISPLACING AND PRODUCING CRUDE OIL

HEAVY OIL RECOVERY BY HIGH VELOCITY NON-CONDENSIBLE GAS INJECTION

This is a continuation in part of an application filed Dec. 22, 1982, Ser. No. 452,200, now U.S. Pat. No. 4,516,636. The present invention relates to enhanced oil recovery, employing high velocity gas injection.

Enhanced oil recovery has been conducted with a variety of driving techniques using fluent driving media of various types—compressed air to propagate a combustion front, steam, carbon dioxide, hot water, propane, and still other fluids. In all of these, conditions are adjusted to implement a piston model of driving medium in relation to the oil to be recovered from a heavy oil reservoir. Widespread usage of these methods is limited by considerations of cost, efficiency and reliability. See, generally, Chapter 1 of Van Poolen, "Fundamentals of Enhanced Oil Recovery" (Penwell Publishers, Tulsa, Okla., 1979), and Doscher, "Enchanced Recovery of Crude Oil," American Scientist, March-April 1981, pp. 193-199.

It is therefore an object of this invention to provide an improved method of recovering oil which employs a high velocity non-condensible gas drive.

It is a further object of this invention to provide a gas drive for the recovery of heavy oils which is more efficient than conventional steam drive.

SUMMARY OF THE INVENTION

I have discovered that contrary to the piston model which as dominated the physical design, apparatus used, and methodology of implementation in prior efforts aimed at enhanced oil recovery, a more significant model of effective recovery is based on interfacial stripping of the reservoir fluids by the fluid which is injected into the reservoir for the purpose of recovering the reservoir oil. Interfacial stripping is the dominant mechanism when the density and viscosity of the injected fluids are substantially less than those of the reservoir fluids. The difference between the piston model and the stripping model for enhanced oil recovery is well illustrated by reference to the steam drive which is typically a most successful enhanced oil recovery process.

In the classical analytical derivation of the way in which a steam drive functions it is assumed that a steam zone is developed which occupies the entire cross section of the reservoir, and that the oil saturation in the steam zone is reduced to some low level by frontal steam displacement. The fact is however that the pressure required to displace a viscous oil bank at an appreciable rate can rarely be achieved in a real reservoir.

Repeated field results in California indicate that the steam enters the formation through a depleted or wet zone, then migrates to the top of the oil saturated interval (if injection was not initiated thereat) and the steam zone then thickens in a vertical (downwards) direction. See, for example, Blevins et. al., "The Ten Pattern Steam Flood", J. of Petroleum Technology (Dec. 75), pp. 1505-1514. Scaled physical model studies have also indicated that the heated oil at the interface between the oil column and the overlying steam zone is entrained or dragged along to the producing well by the flowing steam and condensed water. I have discovered that the steam drive is in fact a two stage process involving: (1) the heating of the crude oil at the interface between the stratified flowing steam and the underlying oil column, and (2) the displacement, entrainment or otherwise mobilization of the crude oil at the interface by the high velocity of the steam (vapor).

The interfacial tension of a crude oil against saturated steam has been verified to be little different from that of oil against water. Two other parameters may account for the observed low residual oil saturations that are observed in steam drive operations: emulsification of the oil, and/or the high velocity of the gas (steam vapor).

The term "emulsion", as used in this art, denotes any mixture of oily material with other fluid, including but not limited to true emulsions. And, it must be understood that high velocity, per se, of the driving gas may not be the direct cause of the observed improved results. While I do not wish to be restricted to a particlar physical explanation of these results, I have discovered that high velocity causes oil to be entrained, or dragged, or otherwise transported through and ejected from a porous medium, such as an oil producing reservoir.

It should be noted that the injection of 500 barrels of steam per day into a reservoir at an average reservoir pressure of 150 psi is equivalent to the injection of some 3 MMSCFD of an ideal gas (before condensation of the steam is considered). Extrapolating from experience with the simultaneous flow of gas and liquid through porous media, considering the steam vapor to be the gas and the aqueous condensate the liquid, the vapor saturation in the porous media swept with steam will be proportionately smaller than its concentration in the flowing steam and that of the liquid proportionately higher. The velocity of the vapor will therefore be very high; as high as 100 or more feet per day. Of course, the velocity decreases as condensation occurs, but this is offset somewhat by the drop in pressure and expansion of the remaining vapor.

Thus, a steam drive conducted as reported herein will be characterized by a relatively high vapor velocity and by the simultaneous flow of gas (steam vapor) and liquid water. Further, because of the very low density of the steam vapor it will rise, no matter where it is injected into the formation, as long as there is some small value of vertical permeability, to the top of the formation, or to the boundary between oil saturated permeable sand and an overlying impermeable barrier.

The steam, having risen to an impermeable boundary, will now course through the formation at the top boundary of the formation and/or the internal boundaries between oil saturated permeable sand and impermeable intervening layers. In a sand or sandstone reservoir such intervening impermeable layers will be shales and silts.

As the steam courses through the formation at an interface between an upper impermeable boundary and the oil column, it will drag a thin layer of heated oil with it. The fact that the oil will become heated by the flow of steam is obvious, and I have discovered, based on laboratory experiments and field operations, that the performance of the steam drive is accounted for by the drag or entrainment of the heated oil in the high velocity steam flow.

The entrainment of the oil is effected by both the high velocity of the steam vapor and the associated flow of steam condensate. The totality of the three components moves through the reservoir as a foaming, bubbling emulsion or foaming, bubbling dispersion of oil in water.

Of critical importance to this invention is the realization that gas phase velocity is a determining factor in oil recovery rate and ultimate recovery. However, scaled physical model studies have also shown a relationship between the viscosity of crude oil and the efficiency of steam in displacing and ultimately producing the oil. Crude oils having a high viscosity for a particular set of operating conditions will not be profitably recovered by the injection of steam. When the viscosity of the crude is sufficiently high, it will be impossible for any real set of operating conditions to recover the crude profitably using a conventional steam drive.

Hence, auxiliary, synergistic processes will be required to recover viscous crude oils by steam injection. Moreover, any modification of the steam drive that results in a smaller amount of steam being required to recover a barrel of crude oil may well improve the economics of the recovery regardless of the viscosity of the reservoir crude.

This invention results from a further realization that oil can be recovered much more efficiently and effectively by employing a high velocity noncondensible gas drive injected at the rates claimed herein. I have discovered a marked correspondence between a high velocity noncondensible gas drive and a steam drive, and have determined that the high velocity gas drive, injected at the rates claimed herein, is capable per se of displacing, entraining or otherwise mobilizing the crude oil at the interface between the stratified high velocity flowing noncondensible gas and the underlying oil zone.

The foregoing observations and the present invention generally apply to those reservoirs having a self-sustaining structure, that is supported by the mineral matter of the reservoir itself. An example of such a self-sustaining oil reservoir is any of the Kern River field heavy oil reservoirs in Kern County, Calif. An example of a non-self-sustaining reservoir is the San Miguel Field in Maverick County, Tex., see e.g., U.S. Pat. No. 4,265,310, granted May 5, 1981 to Britton, et. al., describing steam injection at high velocity in the middle of a tar sand formation. The steam pressure therein is raised to such a value as to induce a fracture within the tar sand through which the steam is then injected to the producing well. For such a reservoir, the pressure level with which the process is initiated is sufficiently high to induce the fracture.

In accordance with the present invention a non-condensible gas drive or a combined steam and non-condensible gas drive is carried out in reservoirs containing low viscosity crudes or high viscosity crudes which preferably have been heated by the prior or coincident injection of steam, hot water, or the propagation of a combustion wave.

The non-condensible gas is injected under pressure into the reservoir through which it courses below the topmost boundary of the oil column, (e.g., between oil zone and impermeable overburden) and/or just beneath an impermeable streak or layer that occurs within the body of the oil saturated formation, or through flow channels which have been developed by the prior injection of heating fluids. One or more injection wells are provided and one or more producing (e.g., extraction) wells are provided, both reaching down to the depth of the formation, and in a variety of spacing patterns.

The gas is injected at a rate of at least 100,000 standard cubic feet per day (SCFD) (i.e., at standard conditions of 14.7 psi and 60° F.) per acre of oil zone projection.

Injection of non-condensible gas at such a rate causes the gas to drive at high velocity through a flow channel in the reservoir, along the interface of oil saturated sand and an impermeable overlying zone thereby creating an emulsion of oil in reservoir waters (e.g., consendate of injected steam or naturally occuring reservoir brines) and dragging, entraining, ejecting or otherwise transporting the crude oil through the reservoir and to and into the producing well from which the oil is extracted. The gas is injected at a rate no greater than 2,000,000 SCFD per acre of oil zone projection, thereby minimizing the amount of gas required to recover each barrel of crude oil and enhancing the efficiency of the operation.

In one embodiment of this invention, flue gas may be injected into, for example, a 30° A.P.I. crude oil bearing zone which has already experienced significant primary recovery.

In another embodiment of this invention nitrogen is injected via the injection well into a 12° A.P.I. oil bearing reservoir, which has already been heated by the injection of steam. Other non-condensible gases contemplated by this invention include air, methane and carbon dioxide. The impermeable layer may be that of the overburden of the reservoir or any intermediate lens or layer within the gross oil saturated section. An emulsion of heated oil and water is formed under the influence of the high velocity gas and the vaporization and ebullition of hot water into the gas which courses through the formation.

In another embodiment of this invention, an aqueous or other solution of a surfactant is injected along with, ahead of, or in sequence with the non-condensible gas in order to promote and enhance emulsification of the oil in water, thus further enhancing the ability of the high velocity gas to entrain, drag or otherwise transport the oil through the reservoir and to and into the producing well.

The surfactant may be a soap, a petroleum sulphonate, an alkyl aryl sulphonate, an alkyl sulphonate, or any substance which has the ability to economically enhance the emulsifiability of the crude oil and thus enhance its being entrained, dragged, displaced, or otherwise transported through the reservoir and to and into the producing well(s) by the high velocity gas. The surfactant is chosen for its ability to perform this and only this function for the particular reservoir and crude oil being subjected to this invention.

In still another embodiment of this invention, an aqueous solution of an alkaline substance such as sodium hydroxide, sodium silicate, sodium carbonate, or sodium bicarbonate is injected, with or without a surfactant, along with the non-condensible gas in order to react with acidic components of the crude oil to form a compatible soap which further enhances the emulsifiability of the crude oil and its subsequent transport to and into the producing well.

This invention may be practiced at any time in the course of producing crude oil from an oil bearing reservoir, during the primary, secondary, or tertiary recovery stages of operation. It is supplemental to any other recovery scheme involving the injection of fluids that may be used for the purpose of swelling, heating, or reducing the viscosity of the crude oil contained in any particular reservoir.

As employed herein the term "oil zone projection" has the customary meaning of the area included within the delineated boundary of a repetitive unit of injection and production wells.

BRIEF DESCRIPTION OF THE DRAWINGS

Other objects, features and advantages of the invention will be apparent from the following detailed description of preferred embodiments when taken in connection with the accompanying drawing, in which, FIGS. 1–5 are graphical presentations of data corroborating the principles and discoveries which are at the foundation of the present invention, and illustrating certain economic advantages which accrue to those who employ it.

DETAILED DESCRIPTION OF PREFERRED EMBODIMENTS

Figure 3A:
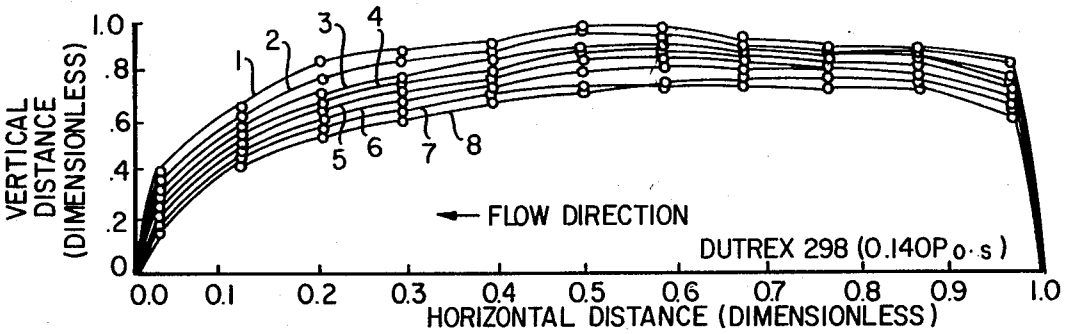

There is shown in FIGS. 1, 2 and 3A–C graphs illustrating the principle that viscosity of oil to be driven by a gaseous phase (steam vapor or non-condensible gas) is a dominant factor in the oil recovery rate and ultimate oil recoverability. FIG. 1. shows that the oil/steam ratio (i.e., barrels of oil produced per barrel of water equivalent steam) is a function of a fractional power (approximately 0.57) of the product of the injected steam quality $f_s$ and the ratio of the kinematic viscosity $V_s$ of the crude oil to that of steam at steam temperature. In effect, the oil/steam ratio is a function of the inverse of the kinematic viscosity of the oil at steam temperature when injecting a steam at a given pressure and quality.

To illustrate the economic significance of this relationship, consider the example of a steam drive in which the injection pressure is 200 psi., and the quality of the injected steam at the reservoir sand face is 0.7. The crude oil in the reservoir has a viscosity at steam temperature (382° F.) of 8.0 centistokes. The value of the abscissae is then $2\times10^{-3}$ and the corresponding value of the ordinate shows that 0.15 barrel of oil will be recovered for each 1 barrel of steam that is injected (a ratio of 6.67 barrels of steam injected to each barrel of oil that is recovered.)

This ratio is generally considered to be an economic one since in order to generate the 6.67 barrels of steam, only approximately half of the produced barrel of crude oil will have to be burned.

Consider now a second reservoir in which all the conditions of the previous example are maintained except for the viscosity of the crude oil. This will now be assumed to be 16 centistokes at steam temperature. The value of the abscissae is now $1\times10^{-3}$ and the corresponding value of the ordinate is reduced to 0.10 barrel of oil recovered per barrel of steam injected (or 10 barrels of steam injected per barrel of oil produced.) This ratio will result in an economic loss to the operator of the project inasmuch as now over 70% of the produced barrel of oil will have to be burned to generate the steam required to produce it.

Analogous data are set forth in papers including "Steam Drive—Definition and Enhancement" by T. M. Doscher, O. S. Omoregie and F. Ghassemi, Society of Petroleum Engineers Paper 10318 and "The Limitations of the Oil-Steam Ratio for Truly Viscous Crudes", Society of Petroleum Engineers Paper 11681 by T. M. Doscher and F. Ghassemi, both of which papers are incorporated herein by reference as if set out at length.

The cumulative oil/steam ratio is important as a measure of profitability and energy balance of a steam drive system. The energy balance is positive (e.g., more energy in the form of oil is extracted by the system than is expended generating steam therefor) if less than some 14 barrels of water are injected as steam for each barrel of oil recovered. (The exact number may be somewhat less or greater than 14 depending upon the quality of the steam that is generated and the thermal efficiency of the steam generator.) However, financial profitability is achieved only if a significantly smaller number of barrels of water are converted to steam to recover one barrel of oil. Again, the exact number will depend on prevaling wages, income and local taxes, cost of water and other utilities, capital investment and interest rates. A representative number for viable economic operation by numerous operators is at this time in the range of 6 to 7.

The laboratory results shown in FIG. 2 indicate that there is an optimum injection rate of steam that will maximize the economic profit of the project. The importance of the velocity (which is directly proportional to injection rate) of the driving gas in recovering crude oil is shown by these results. Here it is shown that as the velocity of the steam (i.e., the injection rate) increases, for example, from 418 barrels per day (B/D), the oil steam ratio, which we have identified as a very important economic parameter, also increases. With further increases in velocity, however, an optimum (in this test 657.5 B/D) is reached which when surpassed results in a decreasing value of the oil steam ratio. This optimum occurs in the case of steam because of the increasing inefficiency of velocity to result in a greater transport of the heated oil (e.g., as the flow channel widens the stripping of the layer of oil adjacent to the overriding gas flow is not enhanced proportionately to increases in the linear flow rate of the gas phase) and because of a limitation on the amount of heat that can be transferred from steam to the reservoir fluids across the interface between them.

Figure 3B:
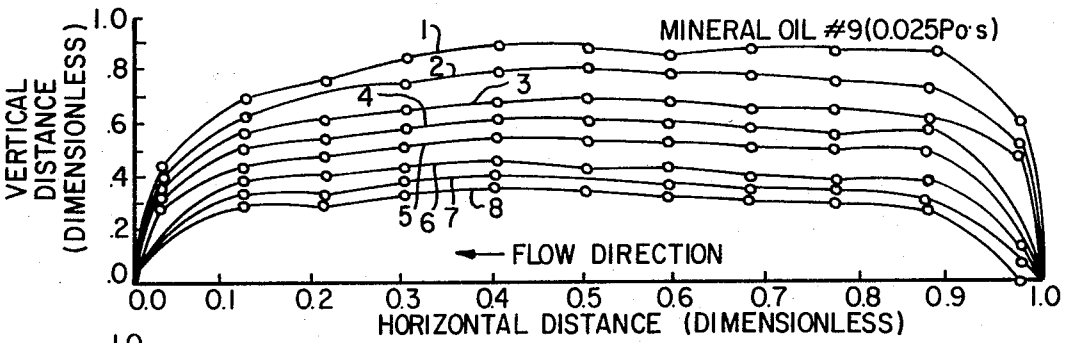
Figure 3C:
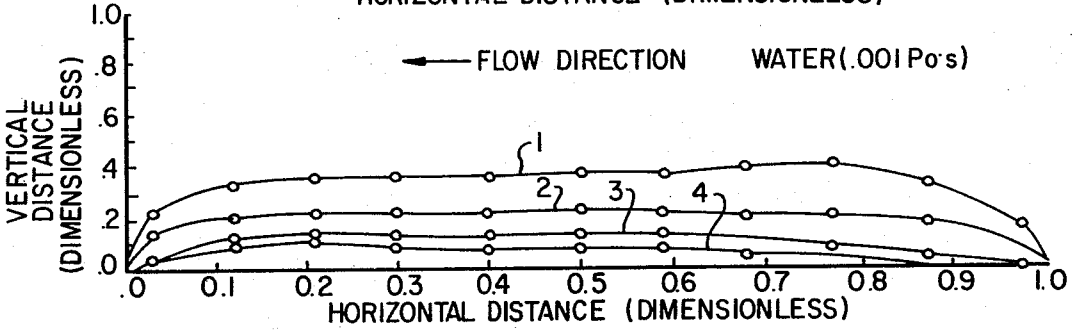

As shown in FIGS. 3A–C, the fluid recovered in a gas driven system varies dramatically with viscosity of the swept fluids. FIG. 3 specifically shows the results of laboratory experiments on non-condensible or inert gas (nitrogen) injection into sand packs filled with various fluids having differing viscosities. For example, FIG. 3A discloses the use of Dutrex 298 having a viscosity of 0.140 Pa.s; FIG. 3B illustrates the use of mineral oil #9 having a viscosity of 0.025 Pa.s; and FIG. 3C shows results when water having a viscosity of 0.001 Pa.s is employed. In each of the individual FIGS., 3A, 3B and 3C is shown the progressive position over times 1–8 of the interface between the overriding gas zone and the underlying column of reservoir fluids. The times are as follows:

TIME 1=300 secs
TIME 2=900 secs
TIME 3=1800 secs
TIME 4=2700 secs
TIME 5=3600 secs
TIME 6=5400 secs
TIME 7=7200 secs
TIME 8=9000 secs It is seen that in these instances of gas injection into oil saturated sand packs the oil is progressively stripped away from the interface by the flowing gas resulting in a gradual fall of the interface. Further, when the viscosity of the fluids are considered, varying from a high value of 0.140 Pa.s to a low value of 0.001 Pa.s, the rate at which the fluids are stripped away (and therefore produced from the sand pack) varies inversely with the viscosity of the fluids. In other words, in the most viscous model, FIG. 3A, the vertical displacement of the non-condensible gas/oil interface occurs much slower than for the least viscous fluid of FIG. 3C.

Figure 4:
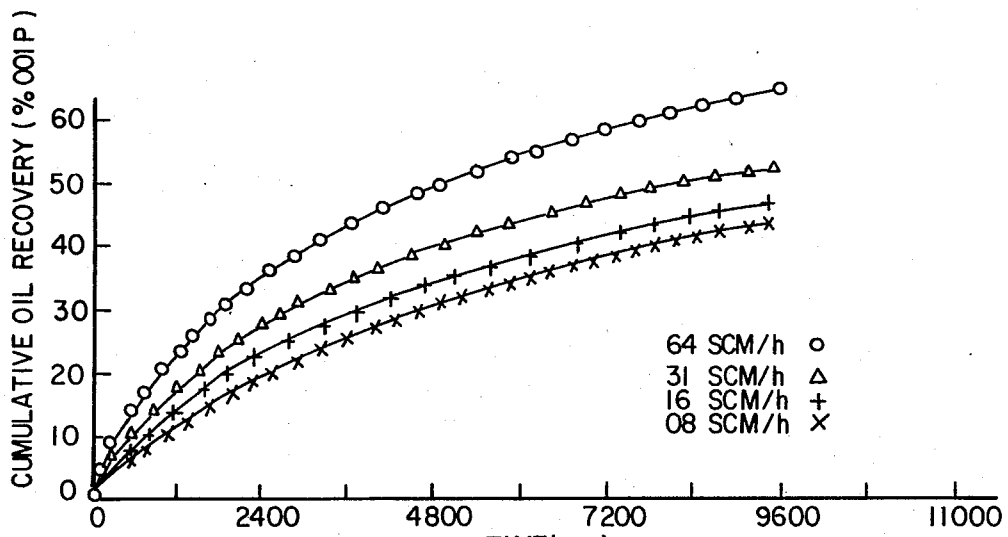

In FIG. 4, the relationship of recovery, as a function of time and velocity (injection rate) is shown for one of the test fluids described in FIG. 3A-C. Were this data to be recast as in FIG. 2 (with "oil produced/SCF gas injected" as the ordinate and "SCF of gas injected" as the abscissae, a family of curves as in FIG. 3 would be developed. Thus, the experiments clearly show the effect of a high velocity gas driven in producing fluids, such as crude oil, from a porous medium, such as a subsurface crude oil reservoir. Moreover, as depletion of oil occurs the linear flow rate itself decreases because of the widening of the natural flow channel that had been erstwhile filled with oil.

Quite clearly, therefore, as the viscosity of the oil reservoir increases beyond a certain level, the amount of steam required to effect recovery becomes prohibitively expensive to produce and steam recovery becomes inefficient (e.g., an amount of oil equal to most, if not all of the oil recovered, is used to generate the steam.)

However, I have determined that relatively low cost non-condensible gases may be substituted partly or entirely for the steam, and that such gases recover oil effectively and efficiently. The results of a laboratory experiment, shown in FIG. 5, show that the injection of nitrogen, an inert gas, at a rate of 500,000 SCFD can be substituted for some of the steam being injected into an already initiated steam drive to continue the production of crude oil while maintaining a reduced rate of injection of steam. It is therefore apparent that the use of high velocity gas can be used for the recovery of crude oil. As shown, the nitrogen may be alternated with or injected simultaneously with steam. The steam is provided to heat viscous oil deposits thereby reducing their viscosity.

All the foregoing descriptions of the steam drive and high velocity gas drive show a marked correspondence between the two processes. The non-condensible gas performs interfacial stripping very effectively taking into account the time value of invested money, the value of crude oil, and the low intrinsic cost of injected gas it is apparent that the use of high velocity gas will economically recover crude oil from numerous reservoirs. Moreover, gases such as flue gas, which would otherwise be wasted, are put to profitable use.

Figure 6A:
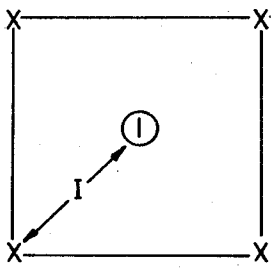
FIG. 6A is a diagramatic view of a five spot pattern upon which the method of this invention may be practiced.
Figure 6:
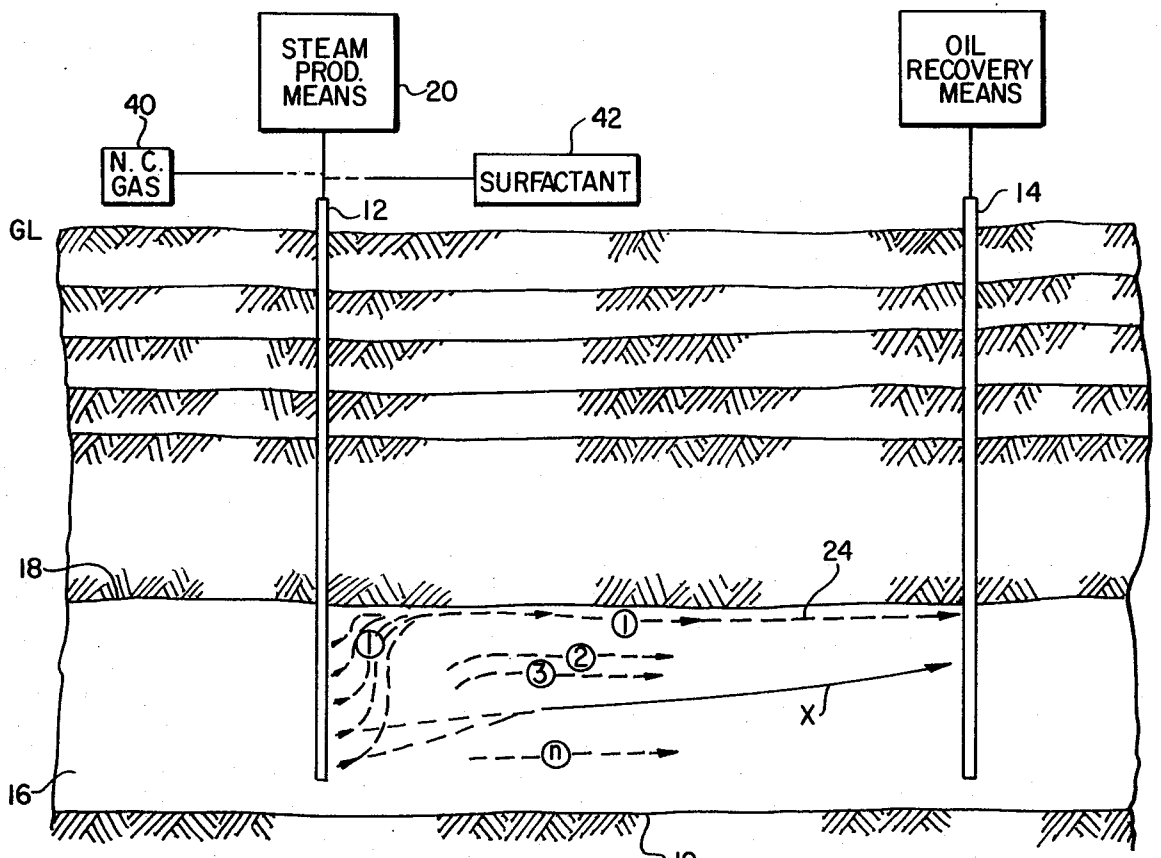
FIG. 6 is a cross sectional view of in-place apparatus illustrating practice of preferred embodiments of the present invention.

In a preferred embodiment of this invention, FIGS. 6 and 6A, an injection well 12 and production well 14 straddle a heavy oil zone 16 located beneath overburden 18. Typically, wells 12 and 14 will be part of a well pattern such as the five spot pattern shown in FIG. 6A.

Each well extends through overburden 18 and into a self-sustaining oil zone 16 and terminates proximate the bottom 9 of the zone 16.

In this instance the crude oil has an A.P.I. gravity of 16°, and the oil sand projection is 2 acres. A flue gas, 40, at whatever ambient temperature level it is made available, is injected in the injection well 12 at a rate of 1,000,000 SCFD (i.e., 500,000 SCFD per acre of oil sand projection). Additionally, an aqueous solution of an alkyl aryl sulphonate surfactant 42, known as Sun Tech IV-1035, is injected into the stream of the inert gas being injected into the crude oil reservoir. The exact amount of the solution and its concentration will be determined by the physiocochemical nature of the crude oil and the mineral content and lithology of the reservoir. As an example, not meant to be limiting, the Sun Tech IV-1035 is injected at the rate of 10 gallons of a 0.5% solution per 1000 SCF of flue gas injected.

The flue gas enters oil zone 16 through perforations along the length of well 12. Because the noncondensible gas is less dense than the reservoir fluids in zone 16, it will course through the reservoir in the topmost natural flow channels that can be developed within the reservoir or a sub-unit thereof. Such a flow channel is likely to occur just beneath the overburden 18 just above the oil bearing zone, line 1, and/or between oil saturated intervals and an impermeable lens or interval disposed at an intermediate level within the gross oil bearing formation. The gas will flow through the channel, line 1, at such a velocity to strip off the adjacent, underlying thin layer of oil thereby creating an emulsion of oil in reservoir waters which is driven by entrainment, drag or other mechanism through the formation and to and into the producing well. If a horizontal fracture X is present in zone 16 a certain amount of the gas may be driven therethrough.

As the layer of oil at the top 24 of zone 16 is swept up by the gas, the top of the oil saturated portion of the zone 16 is lowered. As gas continues to be injected at the above rate it is driven through the flow channel, line 2, along the interface of the top of the depleted oil saturated zone thereby entraining a second layer of oil. Subsequently, entrainment of each succeeding top layer of the oil is performed, along line 3 and so on down to line n, e.g., successive layers of oil are removed from the oil zone by oblative erosion.

The non-condensible gas is injected via well 12 at a rate no greater than 2,000,000 SCFD. At above this rate, the increased gas velocity does not provide proportionately high oil recovery.

As the top of the oil within zone 16 is gradually lowered (e.g. to below lines 1, 2, 3 . . . n), it is clear that the flow channel (the space between the overburden 18 and the top of the saturated oil) is correspondingly increased in volume. Such an increase reduces the velocity of the driving gas and thus the injection requirement for maintaining adequate entrainment of the crude oil would be increased were it not for the presence of the surfactant, in this case the Sun Tech IV-1035. The solution of the surfactant, being denser than the non-condensible gas, will gravitate downwards within the flow channel under the influence of its higher density as it simultaneously migrates forward under the influence of the velocity of the gas and the associated pressure gradient. Ultimately, the surfactant reaches the boundary oil layer where by lowering the interfacial tension between the oil and water in the reservoir, it enhances emulsifiability of the oil and therefore the mobilization and transport of the boundary layer, thus offsetting the influence of the reduced velocity as a result of the widening of the natural flow channel as described above.

In practice, the recovery process may be separated into a heating phase and a recovery phase. Steam, from steam producing means 20 or hot water, or the propagation of a combustion front may be used particularly in more viscous oil zones to heat the reservoir and then recovery may be effected economically by the injection of an inert gas in accord with this invention. The prior application of heat will not be necessary to the successful implementation of this process of recovering oil under the influence of high velocity gas, particularly when the activity of the high velocity gas is enhanced by the inclusion of properly chosen surfactants and alkaline substances.

The injection rate of gas and surfactant can be varied as required to optimize recovery as long as the non-condensible gas is injected within the claimed rates and such injection may be interrupted to heat or reheat the reservoir to a desired temperature level for optimizing the process. Steam may also be injected coincidently with non-condensible gas injected at the claimed rates.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and technique herein disclosed and limited solely by the spirit and scope of the appended claims.

What is claimed is:

1. A method of enhanced recovery of oil from oil zone disposed below an impermeable zone, said method comprising the steps of:

injecting a non-condensible gas under pressure via an injection well into said oil zone at a rate at least 100,000 standard cubic feet per day (SCFD) per acre of oil zone projection to cause the gas to drive through a flow channel delineated between the impermeable zone and the underlying oil with sufficient velocity to mobilize a layer of oil at the top of said oil zone thereby creating an emulsion of oil in reservoir waters which is driven through the reservoir to the producing well for removal of said oil, said gas being injected at a rate no greater than 2,000,000 standard cubic feet per day (SCFD) per acre of oil zone projection.

2. The method of claim 1 wherein the non-condensible gas includes nitrogen.

3. The method of claim 2 wherein the non-condensible gas includes flue gas.

4. The method of claim 3 wherein the non-condensible gas includes air.

5. The method of claim 2 wherein the surfactant includes a soap.

6. The method of claim 2 wherein the surfactant includes an alkyl aryl sulphonate.

7. The method of claim 2 wherein the surfactant includes an alkyl sulphonate.

8. The method of claim 2 wherein the surfactant includes an alpha olefin sulphonate.

9. The method of claims 1 wherein the non-condensible gas includes methane.

10. The method of claims 1 wherein the non-condensible gas includes carbon dioxide.

11. The method of claims 1 wherein the non-condensible gas includes a mixture of at least two gases from the group which includes nitrogen, flue gas, air, methane and carbon dioxide.

12. The method of claim 1 further including injecting a surfactant into the oil zone along with, ahead of or in squence with the non-condensible gas to promote mobilization and transport of crude oil through the reservoir and to and into the production well.

13. The method of claim 13 wherein the surfactant includes a petroleum sulphonate.

14. The method of claim 1 wherein an aqueous solution of alkalizing compound is injected into the oil zone along with said non-condensible gas for recting with acid components in the crude oil to produce a soap for reducing the interfacial tension and thereby aiding in the mobilization and transport of acid-bearing crude oils.

15. The method of claim 14 wherein said alkalizing compound is selected from the group which includes sodium carbonate, sodium bicarbonate, sodium silicate and sodium hydroxide.

16. The method of either of claims 1 further including heating said oil zone prior to injecting said non-condensible gas.

17. The method of either of claim 16 in which the injection of gas is interrupted to reheat the reservoir to a desired temperature level.

18. The method of claim 17 in which said heating is accomplished by driving a combustion front through said oil zone.

19. The method of claim 16 in which said heating is accomplished by injecting steam into said oil zone.

20. The method of claim 16 in which said heating is accomplished by injecting hot water into said oil zone.

21. The method of either of claims 1 in which steam is injected coincidently with said non-condensible gas into said oil zone.

22. The method of claim 1 in which hot water is injected coincidentally with non-combustible gas into said oil zone.

* * * * *